US006042888A

United States Patent [19]

Sismanis et al.

[11] Patent Number: 6,042,888

[45] Date of Patent: Mar. 28, 2000

[54] AESTHETICALLY PLEASING PRINT ARTICLE AND PROCESS TO MAKE THE SAME

[76] Inventors: Leo Sismanis, 17445 Via Cuatro Caminos, Rancho Santa Fe, Calif. 92067; Stephen J. Christopher, 1077 Saphire St., San Diego, Calif. 92109

[21] Appl. No.: 09/126,938

[22] Filed: Jul. 30, 1998

[51] Int. Cl.[7] ..... B05D 1/32; B05D 1/38

[52] U.S. Cl. ..... 427/256; 427/261; 427/265; 427/282; 427/287; 101/129

[58] Field of Search ..... 427/282, 256, 427/261, 265, 287; 101/129; 428/201, 203

[56] References Cited

U.S. PATENT DOCUMENTS 3,912,842 10/1975 Swartz ..... 428/172

5,407,711 4/1995 Lovison et al. ..... 428/13

5,532,046 7/1996 Rich et al. ..... 428/202

*Primary Examiner*—Fred J. Parker

*Attorney, Agent, or Firm*—Higgs Fletcher & Mack; Bernard L. Kleinke

[57] ABSTRACT

A print article and a method for making the print article is disclosed, the print article having an aesthetically pleasing visual appearance and a tactile feel. The print article has a substrate resistant to the passage of lightwaves and has a shiny surface on at least a portion of the substrate. The substrate has a shiny coating disposed thereon or alternatively may be of a metallic material. A graphical image may be disposed on the print article to provide a visual focus for the observer. A projection forming substance is disposed on the print article for creating a projection design that has an aesthetically pleasing appearance and a tactile feel. A conformal flood coat may be applied to protect the print article and provide a glossy finish.

16 Claims, 7 Drawing Sheets

AESTHETICALLY PLEASING PRINT ARTICLE AND PROCESS TO MAKE THE SAME

BACKGROUND OF THE INVENTION

The field of the present invention is the graphic arts. More particularly, the field comprises printing and reproducing an aesthetically pleasing print article and the process of making it.

Graphic artists appreciate that one way to enhance the appeal of a graphical image is to raise or lower certain portions of the image. By raising or lowering certain aspects of the image, ridges and valleys are created that not only interrupt the usually mundane flat surface of a graphical image, but allow the ridges and valleys to interact with light to create interesting and pleasing patterns. Raising a portion of the image above the normal surface is called "embossing" and creating a valley below the normal surface is called "etching". The process of embossing or etching an image not only requires two separate processes but is time consuming and expensive. For example, creating a typical embossed or etched sign required preparing stamps and dyes corresponding to the desired etches or embossed areas. Thus, creating an embossed or etched graphical image was a time consuming, difficult process that required special tools and skills.

It is well known in the art that aesthetically pleasing graphics enhance the quality of various articles including brochures, greeting cards, packaging material, trading cards, T-shirts and other articles that comprise a graphical image. In particular, several previous art patents exist that address improving the aesthetic qualities of signage, such as U.S. Pat. Nos. 3,912,842 and 5,762,379.

For example, U.S. Pat. No. 4,933,218 issued Jun. 12, 1990 shows a sign with a transparent substrate. The '218 patent discloses a process for creating the artificial appearance of an embossed or etched surface on a sign. To create this artificial appearance, a thick ridge of ink is deposited on the back side of a transparent substrate. This thick ridge of ink is disposed in the form of a desired design. A sheet made of paper, plastic or foil is carefully adhered behind the ink ridges and substrate. When an observer looks through the transparent substrate, the ink ridges thereby give a simulated appearance that the design has been etched or embossed on the sign.

Although the sign of the '218 patent artificially creates a visual impression of etching or embossing, the surface presented to an observer is still the flat, mundane substrate. Further, the process can be intricate and cumbersome as the sheet has a transparent adhesive on one side that requires careful handling. Further, the adhesive sheet has to be pressed carefully against the substrate and ink ridges. Applying this adhesive sheet requires the additional process of adhering, rolling or heating to sufficiently conform the sheet to the shape of the substrate and ridges. Additionally, although the sign of the '218 patent may contain color tinting, it does not allow for embossing or etching a complex image.

In U.S. Pat. No. 5,082,703, which was a continuation in part of the '218 patent, other substances are substituted for the adhesive sheet. For example, a silver or gold based solution can be sprayed behind the substrate and the ink ridges. Alternatively, dry reflective powder can be electroplated behind the substrate and the ink ridges. Although this provides alternative ways for providing a backing for the sign, it still entails an additional complicated process such as spraying or electroplating. Thus, the disadvantages of the previous art remained.

The U.S. Pat. No. 5,106,126 patent further attempted to create aesthetically pleasing signage by depositing an image in an ink layer on the back side of a transparent substrate and placing a reflective layer behind the image. Therefore, as an observer looks from the front through the plastic substrate, portions of the image appear reflective. However, the reflective layer is still difficult and expensive to apply. The reflective layer is preferably metalized mylar laminated to the image. Alternatively, the reflective layer can be a metallic paint or metallic ink sprayed or dipped behind the image. With the image and reflective material on the back side of the substrate, an observer still views the image by looking through the substrate. Therefore the surface presented to the observer is flat and not entirely interesting.

U.S. Pat. No. 5,223,357 is similar to the '126 patent in that an image is deposited on the backside of a transparent substrate and a reflective surface is placed behind the image. However, with the '357 patent the reflective surface is a holographic film. The holographic film is used to present variable color casts through the image, but the holographic film is expensive and has to be carefully secured to the substrate using an adhesive. Therefore, the process is expensive and resource consuming. Consistent with other previous art, the signage of the '357 patent suffers from being expensive and a flat, uninteresting effect for an observer.

Further, all the patents discussed above require a special and expensive substrate that is substantially transparent. Since the substrate must be transparent, none of the above patents can address the need to print aesthetically pleasing prints on an opaque surface. Opaque surfaces are ubiquitous in the graphic arts and include such everyday surfaces as cardboard, paper, cloth, Styrofoam, plastic sheeting, or other commonly used and inexpensive printable surfaces.

In viewing the signage discussed above, the observer looks through the substrate and views the image or pattern which is disposed on the back side of the substrate. With such a limitation, the images in the previous art can only be applied to one side of the substrate. However, for marketing and other purposes it is often desirable or efficient to print on both sides of a substrate. For example, packaging, greeting cards, trading cards, playing cards, bookcovers, and other such printed articles are enhanced by being printable on both sides of the substrate.

Thus, the previous art does not disclose an economical way to produce an aesthetically pleasing print article having a metallic surface and a tactile feel. Further, the previous art does not allow for this type of printing on two sides of an opaque substrate.

SUMMARY OF THE INVENTION

It is therefore an object of the present invention to provide a process for creating an aesthetically pleasing print article, employing low cost, commonly available substrates, and yet achieve a print article having a shiny appearance and have a clearly well-defined image thereon. Further, both sides of the common substrate should be printable.

To overcome the disadvantages of the previous art and meet the objectives listed above, the present invention provides a process to create a print article. The process starts with a substrate selected from one of many common opaque materials. A shiny surface gives the substrate a reflective, elegant appearance. An image may be disposed adjacent the shiny surface, providing a visual focus for the print article. A projection forming substance is disposed over the image or shiny surface for providing projections. The projections are arranged in a design for providing a pleasing visual impression. The projections also protrude to create a clearly well defined visual impression, resulting in a tactile feel for an observer. Finally, a conformal coating may be applied that protects the print article and provides a pleasant finish, but yet retains the tactile feel for the observer.

The invention thereby provides for an elegant, interesting, and versatile print article. Not only is the print article visually appealing, but it has a sophisticated tactile feel as well. And, since the process may use common substrates such as paper, cloth, and plastic, the process yields elegant, yet economical print articles. Further, since the process uses an opaque substrate, both sides of the substrate may be used, increasing the versatility of the process.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

DESCRIPTION OF THE PREFERRED EMBODIMENT

Figure 1:
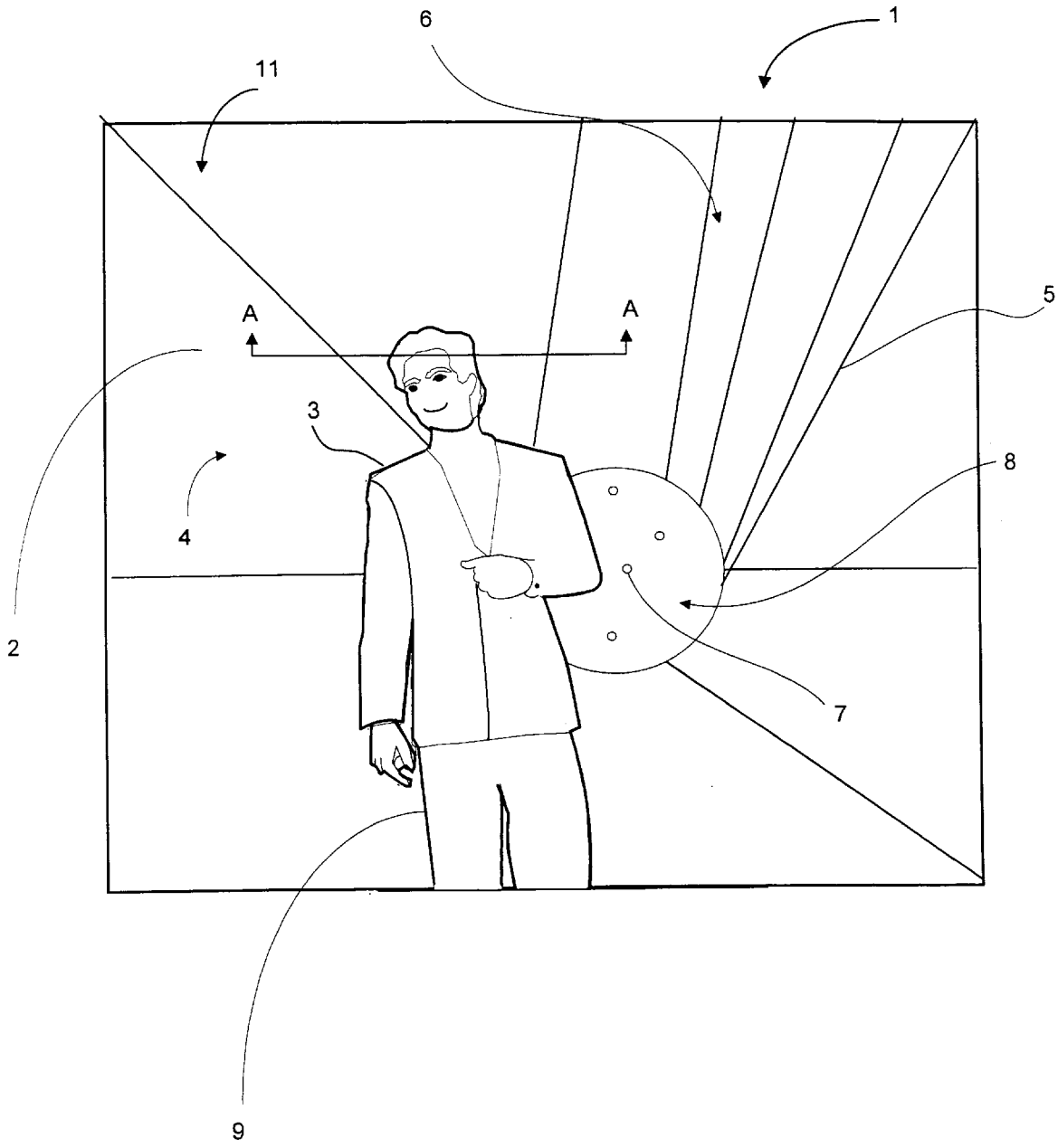
FIG. 1 is a pictorial representation of a front view of a trading card constructed in accordance with the present invention.

FIG. 1 shows a trading card 1 constructed in accordance with the present invention. Trading cards are popular not only among children but also among adults for memorializing famous people, attractions or events. In particular, the popularity of high-end trading cards has escalated in recent times with consumer demand for high quality and aesthetically pleasing cards at an all time high. Indeed, such high end cards are now used to commemorate sport heroes, specific sporting events, fantasy characters, or even popular movies.

In addition to trading cards, the process described above may be used to create other visually interesting effects on substrates. For example, a thin paper substrate can be used to make gift wrap paper, packaging material and letterhead. If the substrate is a thick paper, shopping bags, greeting cards, pictures, brochures, and book covers are possible. By using cardboard, shipping containers and boxes can have an aesthetically placing print according to the present invention. By using a cloth substrate, various clothing items such a T-shirts and shoe emblems can be made. With plastic as a substrate, toys, product trademarks, and other plastic items may have a print article as envisioned by the present invention. As will be readily recognized by one skilled in the art, many alternatives exist for the opaque substrate and the products derived therefrom.

FIG. 1 shows an example of a high end trading card 1. The trading card 1 has a substrate of thick, quality paper stock. A metallic ink 2 is printed on selected areas of the paper stock, with the metallic ink providing a shiny, aesthetically pleasing reflective effect. A four-color graphical image 9 is printed on the trading card 1, which general provides the main focus for the trading card 1. Tactile feel and effect is added to the trading card 1 by adding a projection design which accentuates and highlights various aspects of the trading card. The projection design can accentuate portions of the graphical image, create patterns, or add texture. The projection design is formed from a thick ink that is silk screened onto the trading card 1. Those skilled in the art will recognize other processes to apply the thick ink. Finally, a high-gloss conformal flood coating seals and protects the trading card.

An observer will experience an aesthetically pleasing and interesting visual and tactile experience in handling and viewing the trading card 1. The light from a light source, such as a lightbulb or the sun, strikes portions of the trading card 1. Light striking the metallic ink will reflect back to the observer, inducing a pleasant visual effect creating a feeling of depth and providing a three dimensional aspect to the trading card 1. Further, the projections create a true embossed effect, complete with tactile feel and interaction with reflected light. Additionally, the high-gloss flood coating seals and protects the trading card 1 while providing a high-end glossy finish. Each aspect of the preferred embodiment is addressed below.

Figure 2:
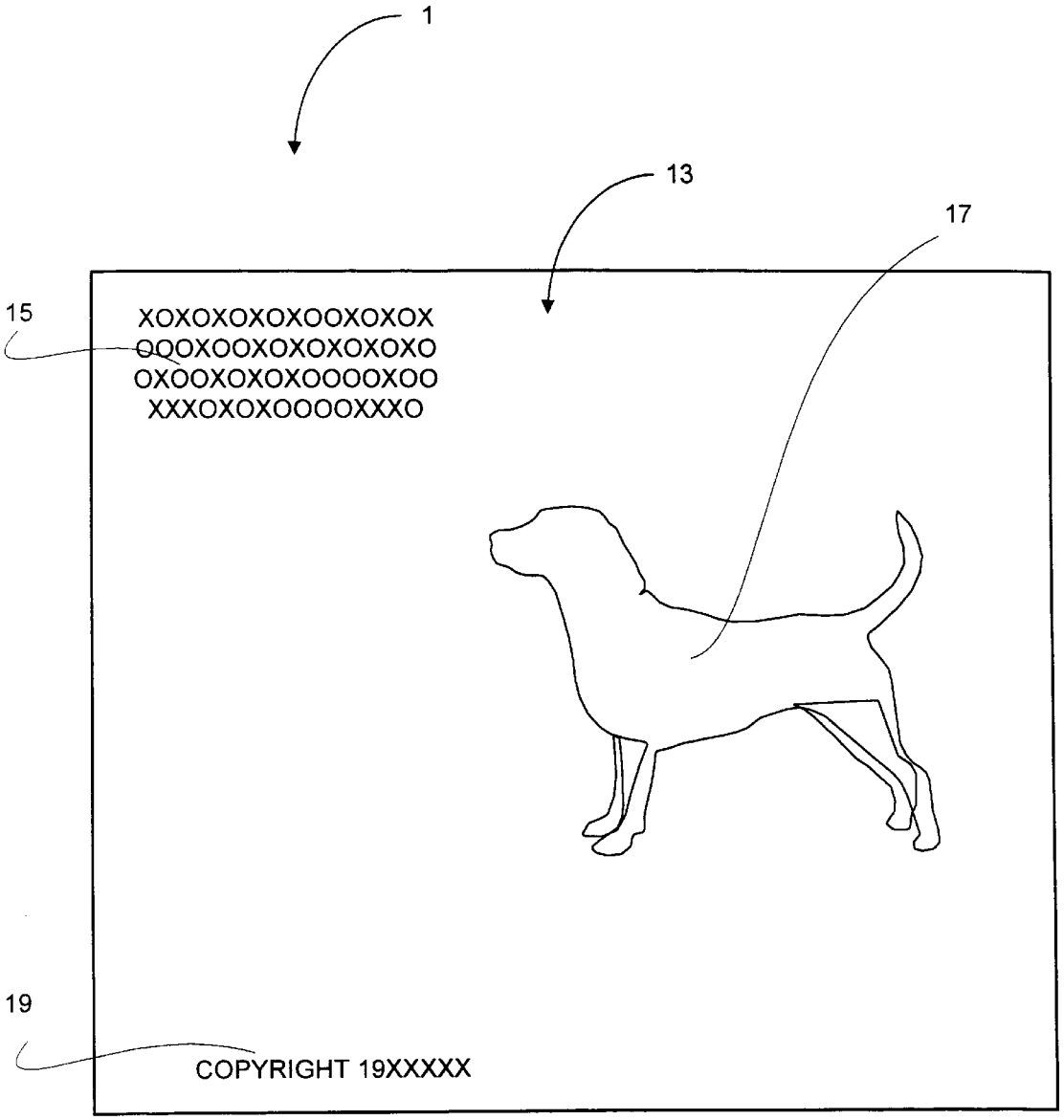
FIG. 2 is a pictorial representation of a back view of a trading card constructed in accordance with the present invention.

The trading card 1 has a standard economical paper stock of a sufficient thickness to withstand the rigors of human handling, display, and trading. Moreover, the substrate can be any thickness that can be accepted by the printing process machinery. Here, the trading card uses a substrate typical of a standard trading card. The trading card 1 has printed material on its front side 11. The front side 11 is the focus of the trading card and provides the primary visual appeal and marketability for the trading card 1. However, as shown in FIG. 2, the trading card 1 also has printing on the back side 13. As would be common in the industry, the back side 13 may include descriptive text 15 describing the subject matter on the front side 11, additional images 17, or a copyright claim 19. Those skilled in the art will recognize several alternatives exists for the material that may be put on the back of the trading card 1. Further, the back side 11 may have no printing at all or may be printed with a one, two, three or four color process. Additionally the back may or may not be coated depending upon the desired effect.

Although trading card 1 uses a paper stock as a substrate, those skilled in the art will recognize that other sheet material such as plastic or cloth will readily substitute.

A coating of metallic ink 2 is dispersed on the front surface of the substrate. Preferably, the metallic ink is applied using an offset lithography printing process. Those skilled in the art understand how a metallic ink is applied using an off-set process, and further understand that a coating of metallic ink may be applied using other techniques such as spraying, silk screening, or dipping. The ink may be printed in a manner that coats the entire surface of the substrate, or may be applied only in selected areas where the reflectivity is desired. Further, the ink may be applied as a clear reflective ink, a tinted ink, or a combination of both. Additionally, the metallic ink may be applied in a manner that includes a design, pattern or image. Those skilled in the art will readily recognize that several alternatives exist to the visual impression for the metallic ink.

The area of the trading card 1 coated with metallic ink 2, plus any area of the substrate not coated with the metallic ink, creates a printable surface. A graphical image 9 may be printed on this printable surface to provide the visual focus for the trading card. For example, the graphical image 9 may be a picture of a sports figure, an animal, the highlight of an event, or a scene from a movie. The graphical image may be printed over the metallic ink 2, which if printed in a translucent ink may provide for reflection of light through the graphical image itself. Alternatively, the graphical image may be printed with opaque ink so no substantial light passes through the ink to the metallic ink surface. Also, the graphical image 9 may be printed on an area of the substrate which does not have a coating of metallic ink. In such a manner, the substrate would not need metallic ink disposed on areas intended to have an opaque graphical image. By not printing the entire substrate with metallic ink, a more economic trading card can be made.

Preferably, the graphical image 9 is printed using an offset printing process. The graphical image can be printed with a one, two, three, or four color process. Those skilled in the graphical arts will recognized other methods of printing the graphical image 9 on to the metallic ink and substrate. If the metallic ink is placed only on a portion of the trading card surface, the graphical image, or a portion thereof, may be printed directly on the paper substrate.

The projection design is composed of projections made from a thick viscous ink which sits above the normal surface of the trading card 1. The projection design may comprise any or all of a pattern projection 6, a texture projection 8, or an image projection 4. FIG. 1 has a pattern projection 6 in the form of a sun with radially extending rays. Although the pattern projection 6 is printed with a clear ink, the observer perceives the sun and ray pattern as a perceivable feature. Inside the sun of the pattern projection 6 is a textured projection 8. The textured projection 8 again is printed with clear ink, but is perceived by an observer as a textural surface providing interesting visual appeal and a tactile feel. The pattern projection 6 and the texture projection 8 comprise pattern projection lines 5 and texture projection lines 7, respectively.

The image 9, too, may accommodate projections on various accentuatable aspects. For example, the image 9 has image projection 4 to accentuate the image. The image projection 4 has image projection lines 3 which outline the graphical image 9 and may also be positioned on selected accentuatable aspects of the image.

An observer viewing the trading card 1 therefore sees the image 9 placed adjacent a shiny metallic surface. Image projection 4, pattern projection 6, and texture projection 8 provide a projection design that presents a tactile surface to the observer. Not only does the projection design present the observer with a tactile surface, but the same projection design interacts with light striking the trading card 1 to create interesting and aesthetically pleasing effects, including an embossed effect.

A high gloss flood coat is placed over the trading card 1 to seal and protect the trading card. Further, the flood coat provides a high gloss finish for the trading card 1. The high-gloss finish adds to the perception of elegance and quality for trading card 1.

Figure 4:
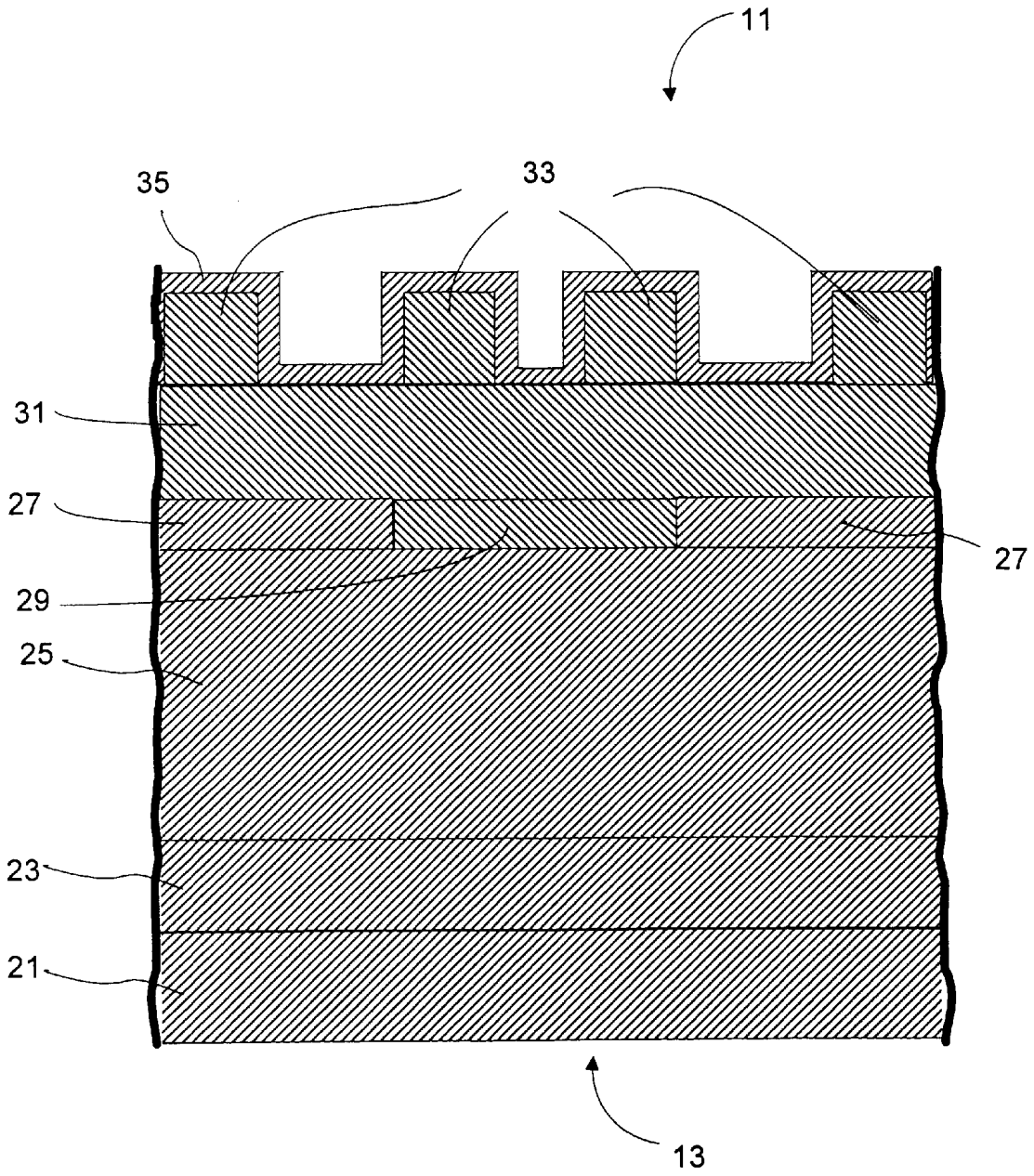
FIG. 4. is a fragmentary, not-to-scale cross-sectional view of line A—A of FIG. 1

FIG. 4 is a cross sectional view of line AA of FIG. 1. This view of the trading card 1, which is not drawn to scale, shows the front side 11 and the back side 13 of the trading card. Paper stock 25 has a metallic ink 27 applied to its top surface. As shown in FIG. 4, the metallic ink may be dispersed only on areas that will not be printed with an opaque graphical image. Alternatively the metallic ink may be applied to the entire substrate. The metallic ink 27 is most conveniently printed on the paper stock 25 using a standard offset printing process although those skilled in the art will recognize other processes to apply a metallic ink to a paper stock. The metallic ink can be of a single or several colors and may even comprise a pattern or image. The ink is applied in a manner resulting in a layer of ink that is substantially uniform.

Front side printing 29 is disposed atop the paper stock 25, generally in areas not coated with metallic ink. The front side printing 29 is most conveniently applied using a standard offset printing process. The process may be a one, two, three or four color process that deposits graphical images or patterns onto the paper stock 25 surface. Those skilled in the art will readily recognize other printing techniques will achieve an acceptable result, such as silk screening, transfer, or hot foil stamping. If the metallic ink is applied to the entire substrate surface, then the front side printing 29 may be applied such that the front side printing 29 provides an opaque surface or may be applied in such a manner to remain translucent, thereby providing for reflection through the graphic image.

An aqueous solution 31 is then placed over the front side printing 29 and the metallic ink 27. The aqueous solution 31 is a sealant protecting the metallic ink 27 and the front side printing 29. Although the use of the aqueous solution 31 is considered optional, using the aqueous solution 31 results in a higher quality, better protected trading card. The aqueous solution 31 is applied using a standard offset printing process resulting in a substantially uniform layer applied across the entire surface of the front side printing 29. Further, the aqueous solution may be applied in-line after the image is printed.

The projection design 33 is then disposed atop the aqueous solution 31. The projection design 33 comprises projections corresponding to the image design 4, the pattern design 6, or the texture design 8 as desired for each trading card 1. Those skilled in the art understand that each trading card does not need or require an image design 4, a pattern design 6, and a texture design 8, as the needs for each card will be dictated by aesthetic and artistic requirements.

Figure 3:
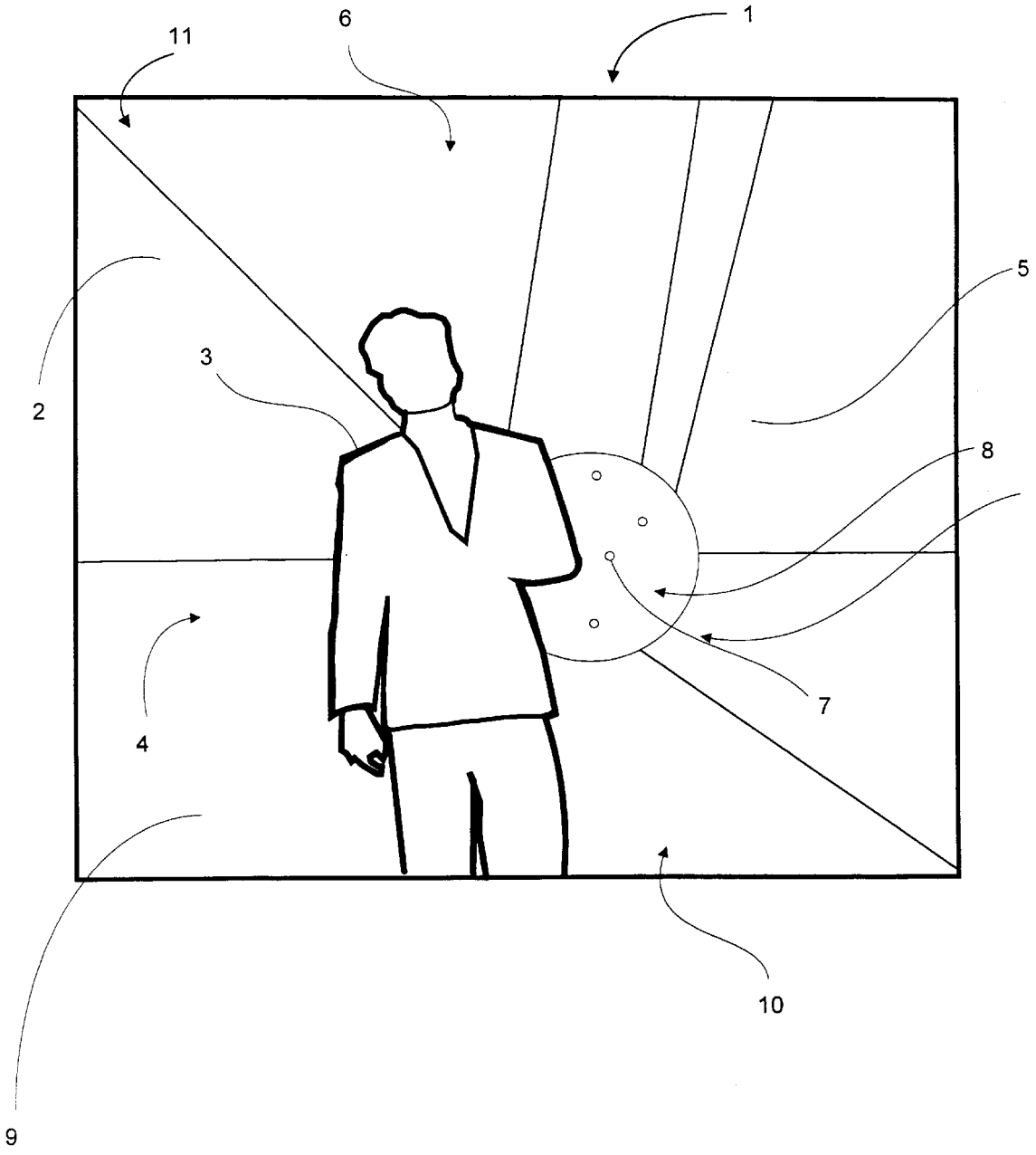
FIG. 3 is a diagrammatic representation of a projection design to be transferred to a silk screen or printed process for disposition on the front side of the trading card shown in FIG. 1.

The projection design 33 is silk screened to the aqueous solution 31. FIG. 3 shows a silk screen 10 having projection design 33. The projection design 33 is shown with an image design 4 where the image is outlined with projections and certain accentuatable aspects of the image are also accentuated with projections. The silk screen further contains a pattern design 6 comprised of a center circle with radially extending rays giving the appearance of a sun. Inside the circle "sun" is a texture design 7 to give an aesthetically pleasing effect to the center portion of the circle.

Those skilled in the art readily appreciate the construction of a silk screen design. The particular silk screen used to apply the projection design 33 is an 305 mesh silk screen. Using such a mesh results in a thick line of ink forming the projections. Other screens can be used to achieve thinner or thicker lines of ink.

The projection forming ink is a thick, low viscosity liquid that retains its vertical height and resists flow after its application. The projection forming substance is preferably a thick ink having a viscosity of no less than 400 cps. Preferably the projection forming ink is curable using UV light. This allows the projection design 33 to be applied to the aqueous solution 31 and then quickly cured before the projection forming ink flows and flattens.

To complete the front side printing, a conformal flood coat 35 is applied over the entire front surface. The flood coat is applied using a standard offset printing process or silk screen process, and is applied in a substantially uniform layer. Those skilled in the art will recognize alternatives exists to applying this flood coat. Also, the flood coat is preferably UV curable so it may be quickly cured. As the flood coat 35 is applied in a substantially uniform layer, the flood coat forms to the contour of the projections created by the projection design 33. By retaining these projections, the card has a true embossed effect and a tactile feel.

The paper stock 25 also has back side printing 13, which is printed after the front side is dry. Preferably the front side is dried for at least 24 hours before the back-side is printed. Those skilled in the art will readily recognize that the back side printing 13 is optional. In the preferred embodiment the back side 13 comprises back side printing 23 which can be a one, two, three or four color process applied to the back side of the paper stock 25. Over the back side printing 23 a flood coat is applied in a uniform layer using an offset printing technique or silk screen process. Preferably the back side flood coat 21 is also curable by UV light. The UV flood coat on the back is not necessarily of the same quality as the UV flood coat on the front side 35. For example, the back side may have a flood coat which results in a less glossy appearance. Not only does this make for a more economical trading card, but does not draw attention away from the front side 11.

Figure 6:
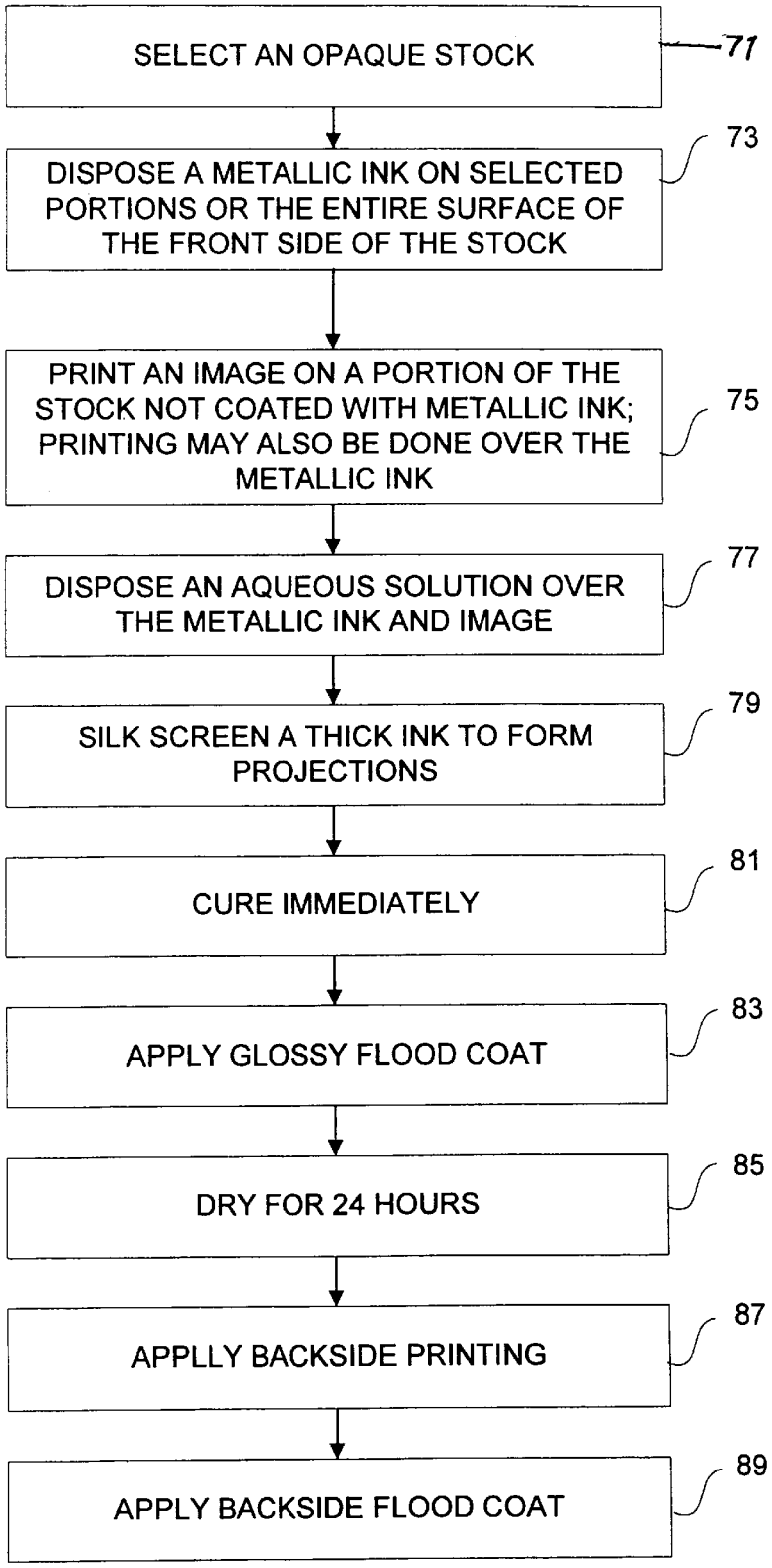
FIG. 6 is a flow chart for the process to make a trading card of in accordance with the present invention.

Trading card 1 is preferably created with the process summarized in the flow chart of FIG. 6. FIG. 6 shows that an opaque stock is selected 71 and then a metallic ink is disposed on selected portions of the front side of the stock 73. Alternatively, the metallic ink may be applied to the entire surface of the substrate. An image may be printed on a portion of the stock not coated with the metallic ink 75. Further, an image, pattern, or color may be printed over the metallic ink. By printing over the metallic ink, that portion of the trading card will have a shiny, reflective visual impression. An aqueous solution is disposed over the metallic ink and printed image 77. A thick ink is silk screened over the aqueous solution to form projections 79 with the thick ink cured immediately 81. A glossy flood coat is applied to the front side 83 and dried for 24 hours 85. At this point any back side printing 87 can be added and a back side flood coating applied 89.

Figure 5:
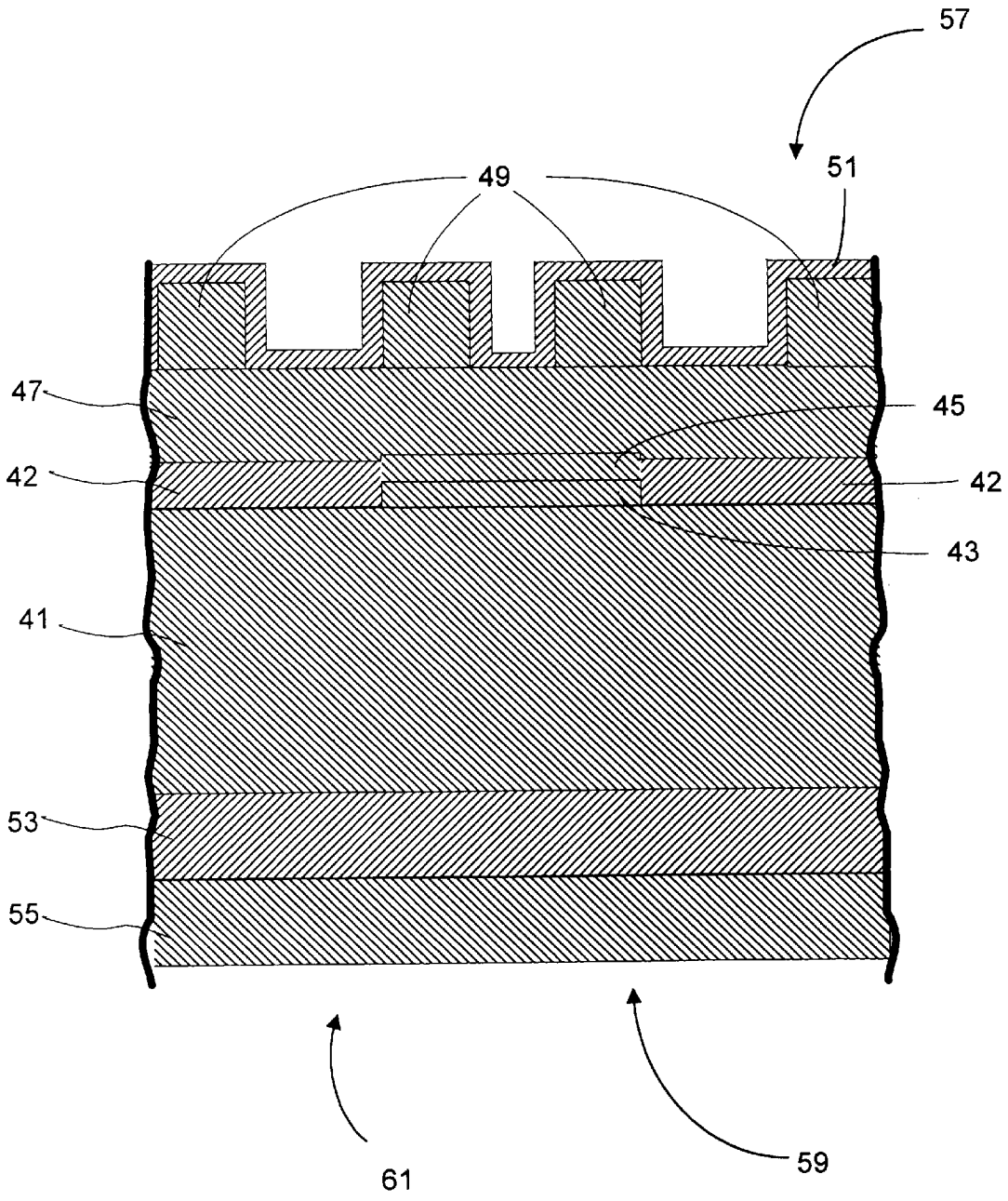
FIG. 5 is a fragmentary, not-to-scale cross-sectional view of another trading card made in accordance with the present invention.

FIG. 5 shows a fragmentary cross section of another print article constructed in accordance with the present invention. FIG. 5 is similar to FIG. 4 with FIG. 5 showing a print article 61 having a front side 57 and a back side 59. In a manner similar to the trading card shown in FIG. 4, the print article 61 of FIG. 5 has a flood coat 51 projections 49, an aqueous coating 47 and a printed image 45 on the front side 57. Also similar to the trading 1 of FIG. 4, the print article 61 of FIG. 5 has back side flood coat 55 and back side printing 53 on back side 59.

However, the substrate for print article 61 is a metalized stock 41. An opaque white ink 43 is printed on to the metalized stock 41 in the areas where a solid unmetalized image is desired. The printed image 45 is then disposed over the opaque white ink 43. The aqueous coating 47 projections 49 and flood coat 51 are applied in a like manner as to the trading card shown in FIG. 4. Further, the back side printing 53 and back side flood coat 55 is also applied in a like manner as compared to the trading card 1 shown in FIG. 4.

The metalized stock 41 is most preferably a metal foil. Those skilled in the art will recognize that other substances exist that present a metalized surface for printing. The foil which comprises the metalized stock 41 is almost always a silver color, although any colored foil could also be used as the metalized stock 41. Further, a holographic foil may be used to produce another interesting effect.

Opaque white ink 43 is now disposed on the metalized stock 41 on selected areas where no metallic effect is desired. For example, a detailed image may have more visual appeal without a shiny, reflective impression. Functionally, the opaque white ink 43 blocks light waves from reaching the metalized stock 41 in the areas below the opaque white ink 43. Although preferably the print article 61 uses an opaque white ink, those skilled in the art will recognize that several alternatives exist including inks of other colors, transfers or other opaque materials that can be disposed on the metalized stock 41.

The metallic surface may be colored by printing an ink 42 on to the surface of the foil. The colored ink 42 may be applied over the entire surface to give a consistent overall color or may be applied to selected areas to create a desired visual impression. Further, the colored ink 42 may be applied in the shape of a design or image to produce a desired visual effect. The colored ink coatings 42 and 45 are preferably applied in a single pass of the printing process. Thereby areas coated with the white opaque ink have a non-metallic impression and the remaining area have a shiny, reflective impression.

A printed image 45 is now disposed on the areas having the opaque white ink 43. The opaque white ink provides a good surface for the application of the printed image 45. The printed image 45 may be applied using a standard lithographic offset process or those skilled in the art will recognize that other processes are readily available. The printed image 45 may be applied as a one, two, three or four color process. Further, the printed image 45 may be applied using a hot foil stamping process. If so desired, an image may be printed on the area having a shiny, reflective surface. Such an image would have a translucent, shiny appearance.

Figure 7:
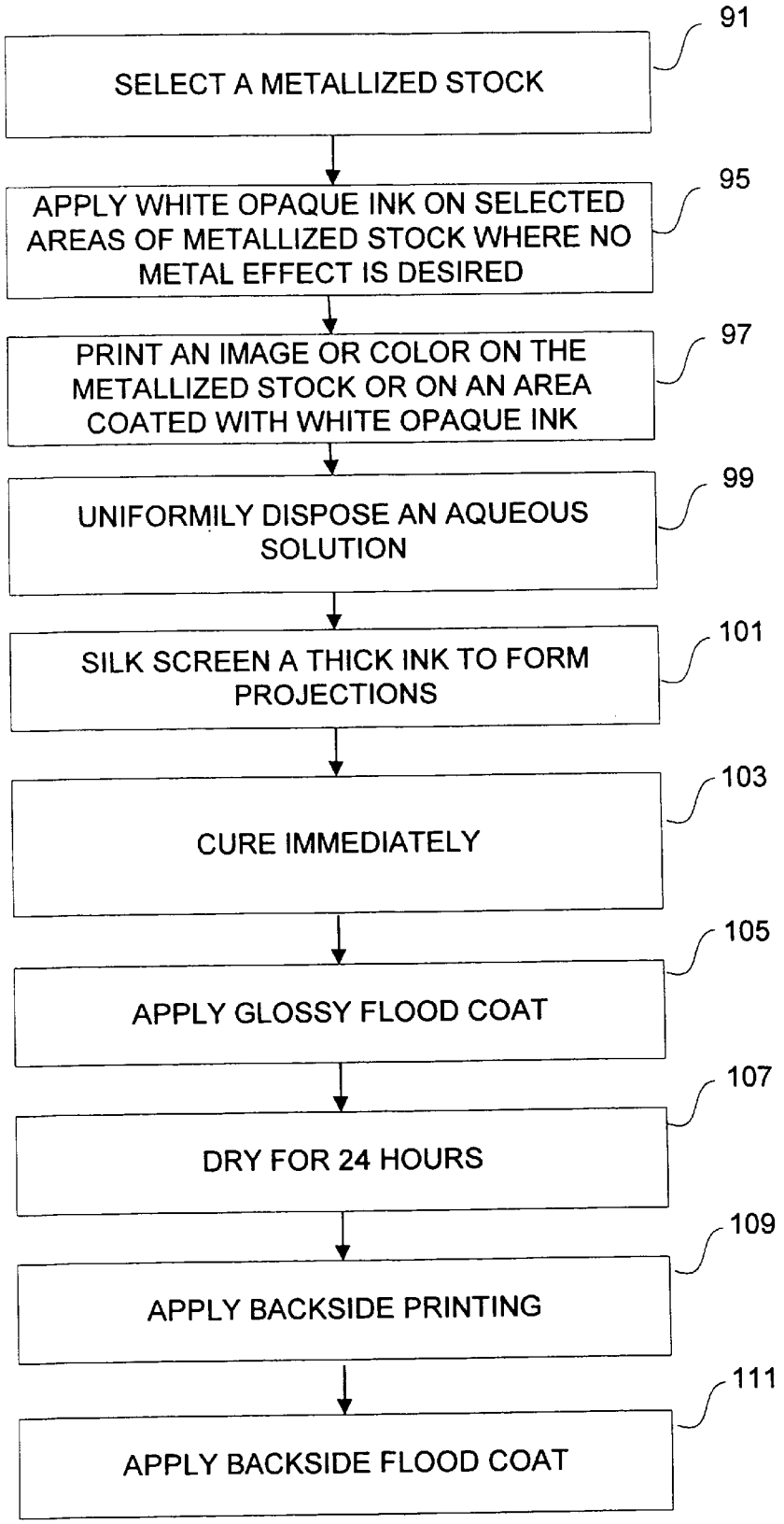
FIG. 7 is a flow chart for another process to make a trading card in accordance with the present invention.

The process to create a trading card using a metalized stock as described above is summarized in the flow chart of FIG. 7. First a metalized stock is selected 91. A color or pattern may be disposed on the metalized stock and/or a white opaque ink may be applied to selected areas on the metalized stock where no metal effect is desired 95. An image is printed on selected areas 97. The image may be printed on the white opaque ink or on the areas not having the white opaque ink. An aqueous solution is deposited over the metallic ink and image 99 and a thick ink is silk screened over the aqueous solution to form projections 101. The thick ink is immediately cured 103 and a glossy conformed flood coat is applied 105. The front side is dried for 24 hours 107 before any optional backside printing 109 or flood coat 111 is applied.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A process to create a print article, comprising:

providing a substrate with a reflective surface for creating a shiny visual appearance;

disposing on the front side of the substrate a coating configured in the shape of an image, the coating positioned adjacent to the shiny surface so that the image provides a visual focus for the observer;

providing means to apply a projection design having accentuatable image features for the image to emphasize selected areas of the image;

applying a projection forming ink at the front side of the substrate using the means to apply the projection design to form projections, the projections arranged to create a projection design that includes the image features, the projections being of substantial thickness for creating both an aesthetically pleasing visual effect and a tactile feel for the observer.

2. The process according to claim 1 further having the step of sealing the print article with a substantially uniform coating of a conformal flood coat for protecting the print article and providing a finish, yet retaining the tactile feel for the observer.

3. The process according to claim 1 where the substrate is paper, cardboard, plastic, or cloth, and the process includes the step of coating at least a portion of the substrate with a metallic ink to provide the shiny surface.

4. The process according to claim 1 where the substrate is a metal foil.

5. A process to create a print article having a tactile feel and an aesthetically pleasing visual effect, comprising:

creating a projection design having projection lines selected from the group consisting of pattern projections, texture projections, and image projections;

disposing on at least a portion of an opaque substrate a coating for providing a shiny, reflective surface;

depositing the projection design onto the coating using a projection forming substance so that the projection design protrudes above the metallic ink for creating an embossed effect and a tactile feel for the print article;

curing the projection forming substance within a time sufficient to retain the tactile feel and embossed effect of the projection design; and applying a conformal flood coat for protecting the print article and providing an additional glossy finish, yet retaining the tactile feel and embossed effect of the projection design.

6. The process according to claim 5 further comprising a step of applying an aqueous solution over the coating before the step of depositing the projection design, the aqueous solution sealing the metallic ink.

7. The process according to claim 5 wherein the coating is a metallic ink.

8. The process according to claim 5 further comprising the step of disposing a layer in the shape of a graphical image on the metallic ink.

9. The process according to claim 5 further comprising the step of disposing a graphical image on an area of the substrate not coated with the metallic ink.

10. A process to create a print article having a graphical image component, comprising:

identifying accentuatable elements in the graphical image; creating a silk screen corresponding to the accentuatable elements;

coating at least a portion of an opaque substrate with a metallic ink for providing a shiny, reflective surface, the metallic ink and any non-coated portions of the substrate creating an image area;

printing the graphical image on at least a portion of the image area;

coating said image area with an aqueous coating;

silk screening a projection forming ink on the aqueous coating to create projection lines, wherein the projection lines are positioned corresponding to the accentuatable elements of the image and are of a substantial thickness for creating both an aesthetically pleasing visual effect and a tactile feel for an observer; and applying a conformal flood coat having a substantially uniform thickness.

11. A process to create a print article, comprising:

providing a silk screen having projection features to be positioned on the print article, the projection features for creating an embossed look and a tactile feel to the print article;

coating at least a portion of an opaque substrate with a metallic ink for providing a metallic, shiny surface;

silk screening a thick ink using the silk screen to provide the projection features onto the print article;

sealing the print article with a substantially uniform coating of a flood coat; and drying the print article and processing the print article into a product.

12. The process according to claim 11 wherein the substrate is selected from the group consisting of paper, cloth, cardboard, and plastic, and the product is selected from the group consisting of trading cards, gift wrap, clothing items, packaging material, shopping bags, and shipping containers.

13. A process to create a print article having a tactile feel, comprising:

selecting a metal substrate that has a shiny, reflective surface for providing a visual aspect of depth;

providing means to deposit a projection design having projection lines selected from the group consisting of pattern projections, texture projections, and image projections;

depositing the projection design onto the metallic substrate using a projection forming substance with the means to deposit the design so that the deposited substance configured in the shape of the projection design protrudes above the metallic substrate for creating an embossed effect and a tactile feel for the print article;

curing the projection forming substance within a time sufficient to retain the tactile feel and embossed effect of the projection design; and applying a conformal flood coat for protecting the print article and providing an additional glossy finish, yet retaining the tactile feel and embossed effect of the projection design.

14. The process according to claim 13 further comprising a step of applying an aqueous solution before depositing the projection design, the aqueous solution for protecting the metallic.

15. The process according to claim 13 further comprising the step of disposing an opaque coating on a portion of the metallic substrate and disposing an image on the opaque coating.

16. The process according to claim 13 further comprising the step of disposing an image on a portion of the metallic substrate.

* * * * *